US006561829B2

(12) United States Patent
Maeda et al.

(10) Patent No.: US 6,561,829 B2
(45) **Date of Patent: *May 13, 2003**

(54) CONNECTOR THAT ABSORBS ALIGNMENT ERROR

(75) Inventors: Tomoharu Maeda, Toyota (JP); Norihiro Ninomiya, Nagoya (JP); Junichi Itoh, Anjo (JP)

(73) Assignee: Japan Solderless Terminal Mfg. Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/468,321

(22) Filed: Dec. 21, 1999

(65) Prior Publication Data

US 2002/0111075 A1 Aug. 15, 2002

(30) Foreign Application Priority Data

Dec. 24, 1998 (JP) ..... 10-376873

(51) Int. Cl.[7] ..... H01R 13/64
(52) U.S. Cl. ..... 439/247; 439/701; 439/79
(58) Field of Search ..... 439/79, 80, 246, 439/247, 248, 701

(56) References Cited

U.S. PATENT DOCUMENTS 5,453,016 A * 9/1995 Clark et al. ..... 439/79
5,827,077 A * 10/1998 Fukuda ..... 439/79
6,045,372 A * 4/2000 Lian et al. ..... 439/83
6,093,033 A * 7/2000 Kuki et al. ..... 439/79
6,095,826 A * 8/2000 Potters ..... 439/79

FOREIGN PATENT DOCUMENTS

| | | |
|---|---|---|
| EP | 0 371 835 A1 | 6/1990 |
| EP | 0 519 254 A2 | 12/1992 |
| EP | 0 519 264 A2 | 12/1992 |
| EP | 0 657 960 A2 | 6/1995 |
| JP | 3-9255 | 3/1991 |

* cited by examiner

*Primary Examiner*—Tho D. Ta
*Assistant Examiner*—Edwin A. León
(74) *Attorney, Agent, or Firm*—Nixon Peabody LLP; Donald R. Studebaker

(57) ABSTRACT

A connector that absorbs alignment error to be connected to a pin-shaped conducting member of the counterpart. This connector includes a base housing to be arranged on a printed circuit board, a slide housing being slidably supported in relation to the base housing in a plane crossing the longitudinal direction of the conducting member of the counterpart, and at least one contact spanning both the housings and being fixed to both the housings and being to be soldered on the printed circuit board. Said slide housing having at least one inlet hole of which one end faces to and opens to the contact and the other end expands toward the end and opens to the conducting member of the counterpart. This connector can effectively absorb alignment error and prevent occurrence of connection failure and defective connection to increase the reliability and enhance the workability of assembly of printed circuit boards.

3 Claims, 12 Drawing Sheets

CONNECTOR THAT ABSORBS ALIGNMENT ERROR

BACKGROUND OF THE INVENTION

1. Field of the Invention

The present invention relates to a connector that is connected to a pin-shaped conducting member of a counterpart connector, and more particularly to a connector that absorbs alignment error, which, when the positional relationship between the connector and the conducting member of its counterpart deviates from the regular one (hereinafter this condition is referred to as existence of an alignment error), can absorb the alignment error and can be connected to the counterpart.

2. Related Art

Printed circuit board connectors, such as one disclosed in Japanese utility model examined publication gazette Heisei 3-9255, have been used extensively. In such a connector, contacts are stored in a housing, one end of each contact is used as a mounting part, put through a through hole in a printed circuit board, casing, etc. and soldered, and a pin-shaped conducting member of a counterpart connector is inserted into a cylindrical connecting part on the other end of the contact to mechanically and electrically connect the conducting member of the counterpart to the printed circuit board.

When such a connector is used, for example, to connect two printed circuit boards (so-called board-to-board connection), the connector and the conducting members of the counterpart that are to be connected together are mounted on the respective printed circuit boards. When the positional relationship between the two printed circuit boards is established according to the desired arrangement in relation to the casing or the like, the positional relationship between the connector and the conducting members of the counterpart may deviate from the regular one, generating an alignment error. If this alignment error is excessive, the conducting members of the counterpart can not be connected to the connector. Even if the conducting members of the counterpart can be connected forcefully to the connector, connection in a strained posture may cause troubles such as cracking in a soldered part, etc. due to excessive stresses, resulting in defective connection. Such alignment errors tend to occur, for example, when a large number of connectors and conducting members of the counterpart are mounted on printed circuit boards and they are made to connect with each other at a time in a board-to-board connection, making it difficult to assemble the printed circuit boards.

SUMMARY OF THE INVENTION

One objective of the present invention is to effectively absorb the alignment error, prevent connection failure and defective connection from occurring, improve the reliability and enhance the workability of assembly of printed circuit boards by dividing the housing into two parts and coupling the two parts with at least one contact in such a way that both parts are floating to each other so that the housing of the connection side can slide in a plane that crosses the longitudinal direction of the conducting member of the counterpart.

To achieve the above-mentioned objective, the connector that absorbs alignment error according to the present invention is a connector to be connected to a pin-shaped conducting member of a counterpart, said connector comprising, a base housing to be arranged on a printed circuit board, a slide housing being supported in such a way that it can slide in relation to the base housing in a plane that crosses the longitudinal direction of the conducting member of the counterpart, and at least one contact spanning both said housings, being fixed to both said housings and being to be soldered on the printed circuit board, said slide housing having at least one inlet hole of which one end faces to and opens to said contact and of which the other end widens toward the end and open to the conducting member of the counterpart.

This connector that absorbs alignment error is mounted by soldering the contact on the base housing side onto the printed circuit board. When the conducting member of the counterpart is inserted into the inlet hole, the conducting member will come close to the contact. When both the conducting member and the contact are soldered or crimped together, the connection will be completed. In this process, even if the center of conducting member of the counterpart and the center of the inlet hole are not aligned with each other due to an alignment error, the conducting member of the counterpart will be received by the wide openings of the inlet hole, and when the conducting member advance in the inlet hole, the slide housing will be slid in relation to the base housing by the elastic deformation of the contact in a plane that crosses the longitudinal direction of the conducting member of the counterpart to absorb the alignment error. Thus the connector and the conducting member of the counterpart can be reliably connected with each other despite the existence of an alignment error. Furthermore, the stresses on the soldered parts, etc. are lessened in proportion to the flection of the contact. Hence troubles such as cracking due to excessive stresses caused in soldered parts by forceful connection can be avoided to prevent occurrence of defective connection. This can enhance the reliability of the connector. Moreover, as the conducting member of the counterpart is accepted by the inlet hole and received smoothly, the workability of assembly of printed circuit boards is improved. The above-mentioned desirable effects are particularly conspicuous when a large number of connectors and conducting members of counterpart are mounted and they are connected at a time to make a board-to-board connection.

BRIEF DESCRIPTION OF THE DRAWINGS

FIG. 4A is a plan view, FIG. 4B is a front view, and FIG. 4C is a bottom view, respectively.

FIG. 7A shows the case of the first embodiment of the connector that absorbs alignment error. FIG. 7B shows a case for comparison.

PREFERRED EMBODIMENT OF THE INVENTION

Figure 6:
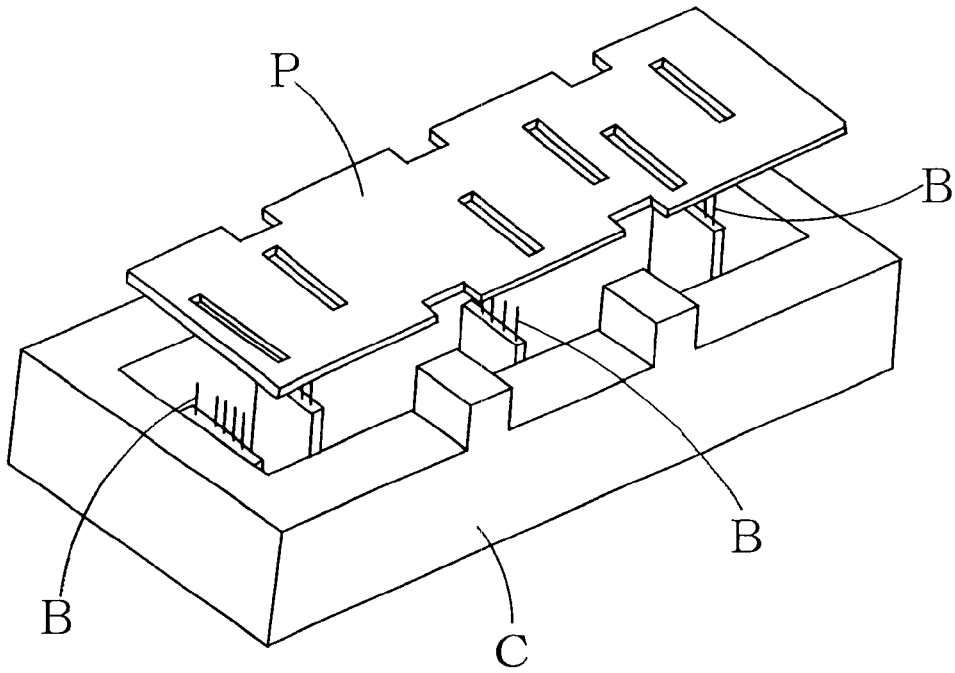
FIG. 6 is a reduced perspective view showing a case and a printed circuit board that are to be connected with the first embodiment of the connector that absorbs alignment error.

In the following, embodiments of the invention will be described with reference to the attached drawings. FIG. 1 through FIG. 5 show the first embodiment of the connector that absorbs alignment error. This connector that absorbs alignment error is mounted, for example as shown in FIG. 6, on a printed circuit board P when a case C and the printed circuit board P are connected with each other. In the example shown in FIG. 6, pin-shaped conducting members B of the counterpart are mounted in the case C in such a way that the conducting members B protrude upwards. The conducting members B of the counterpart are arranged to pass upward through and come out of through windows opened in the printed circuit board P, and to be connected to the connectors that absorb alignment error (not illustrated in FIG. 6).

As shown in FIG. 1 through FIG. 5, the connector of the first embodiment comprises, a housing 1 made of an insulating material and contacts 2 that are made of an elastic conducting material, and the contacts 2 are to be soldered on the printed circuit board P. The connector comprises, a base housing 3 to be arranged on a printed circuit board P, a slide housing 4 being supported in such a way that it can slide in relation to the base housing 3 in a plane that crosses the longitudinal direction of the conducting member B of the counterpart, and contacts 2 spanning both said housings 3,4, being fixed to both said housings 3,4 and being to be soldered on the printed circuit board P. On the top of the base housing 3, clamping parts 5, 5 being formed into a fallen-U-shape and opening forward are provided, one on the right and the other on the left, at a distance from each other. The slide housing 4 is slidably held at the ends 4*b*, 4*b* by these lamping parts 5,5.

Figure 1:
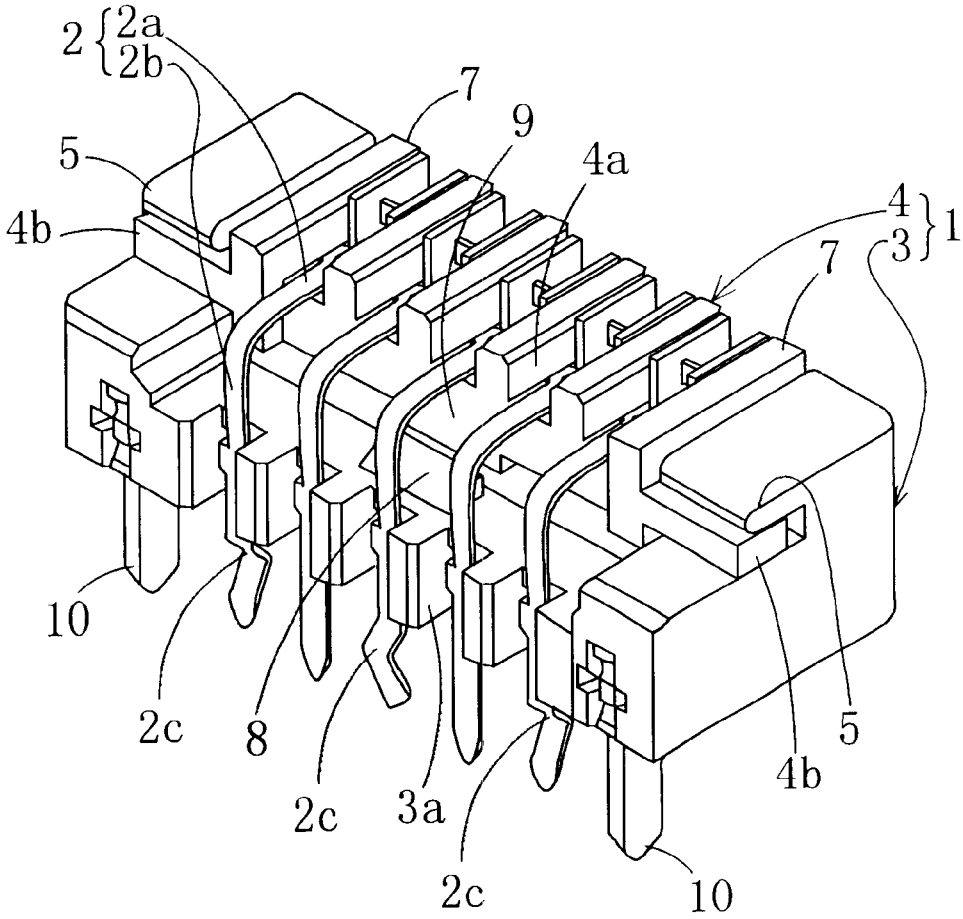
FIG. 1 is a perspective view of the first embodiment of the connector that absorbs alignment error.
Figure 2:
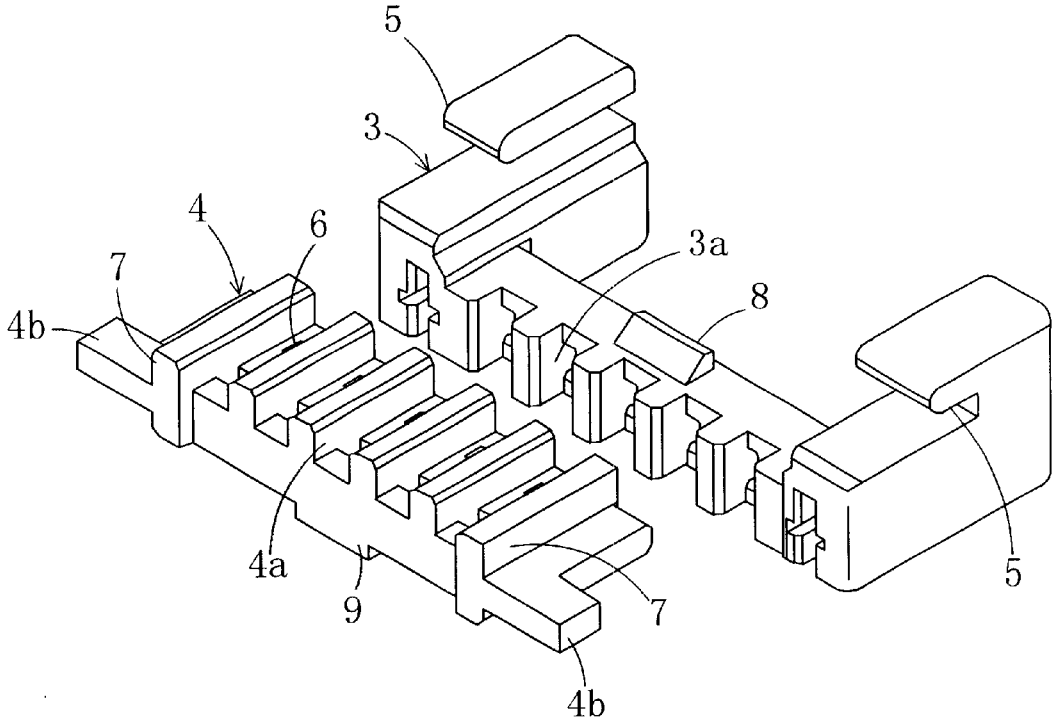
FIG. 2 is an exploded perspective view showing a base housing and a slide housing of the first embodiment of the connector that absorbs alignment error.
Figure 3:
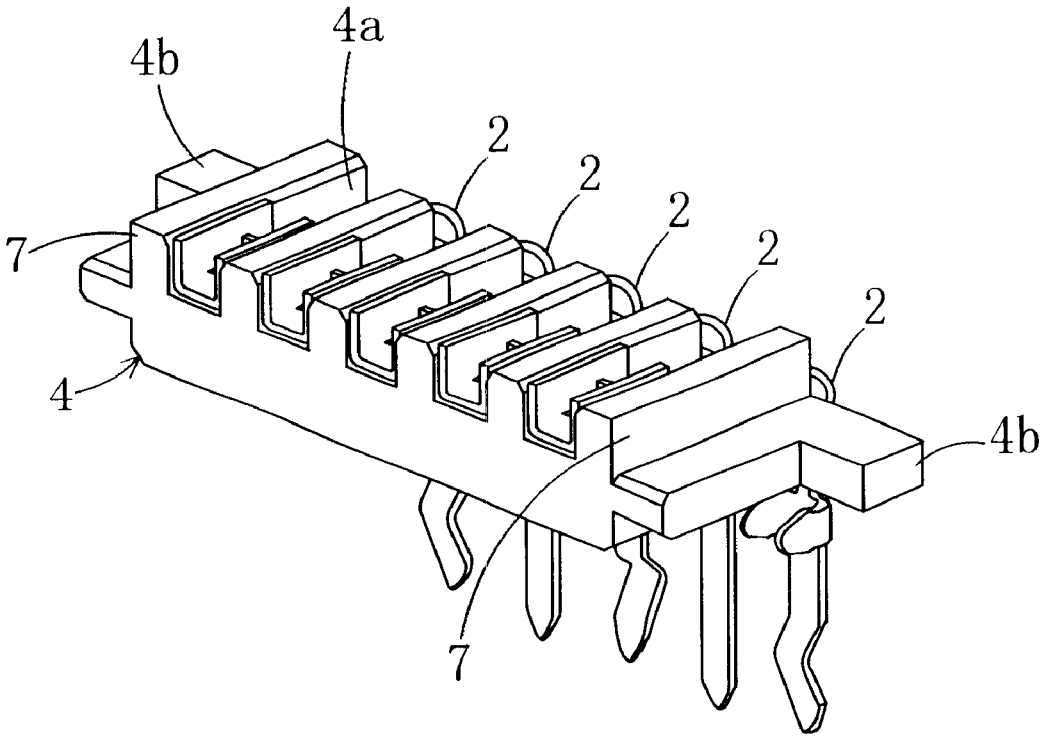
FIG. 3 is a perspective view showing contacts being assembled on the slide housing of the first embodiment of the connector that absorbs alignment error.
Figure 4A:
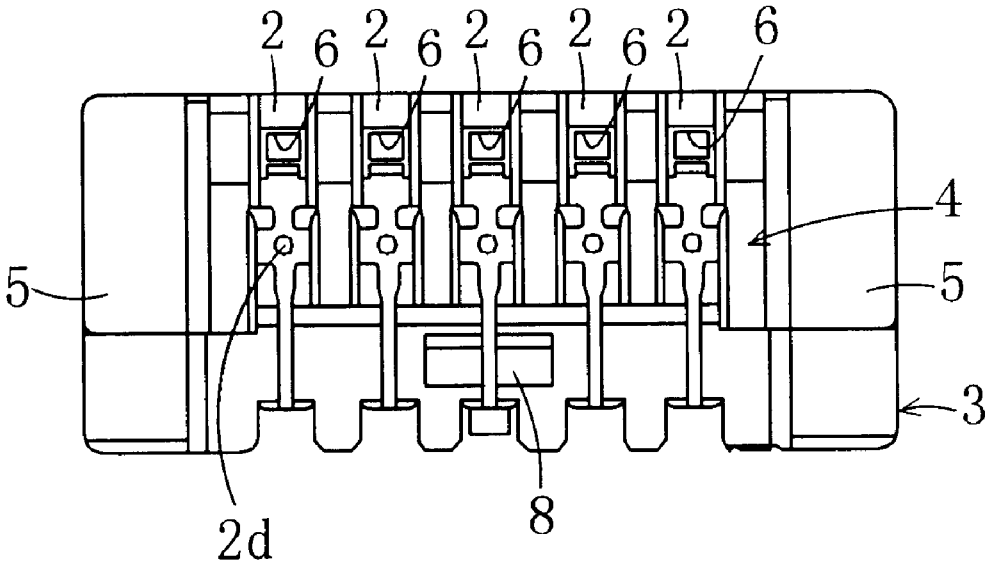
FIG. 4A through FIG. 4C show the first embodiment of the connector that absorbs alignment error.
Figure 4B:
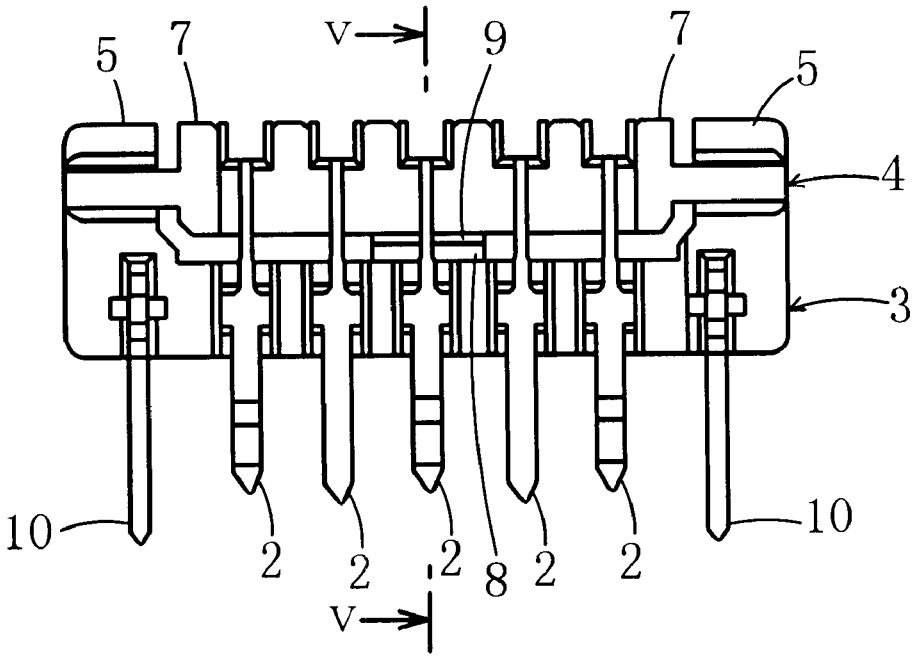
Figure 4C:
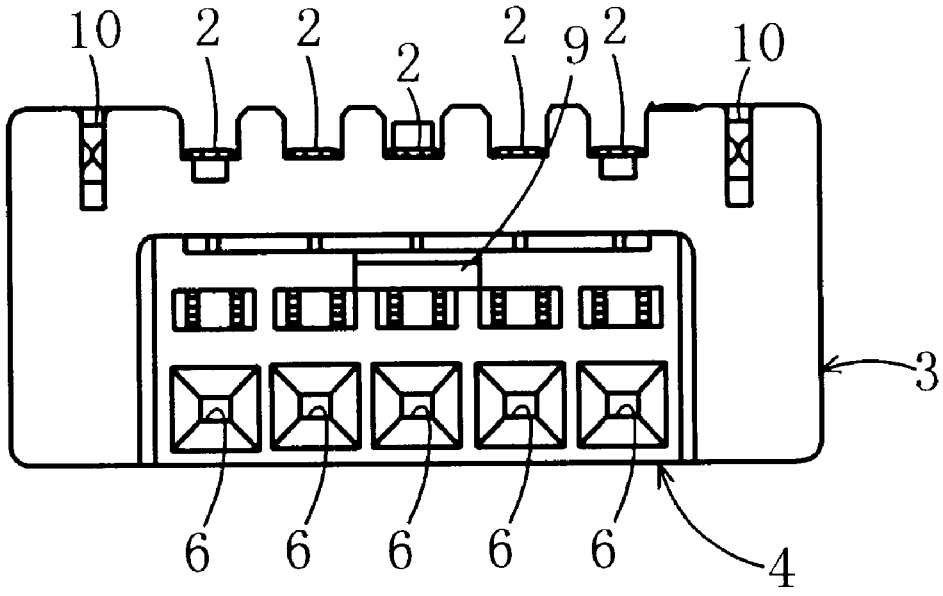
Figure 5:
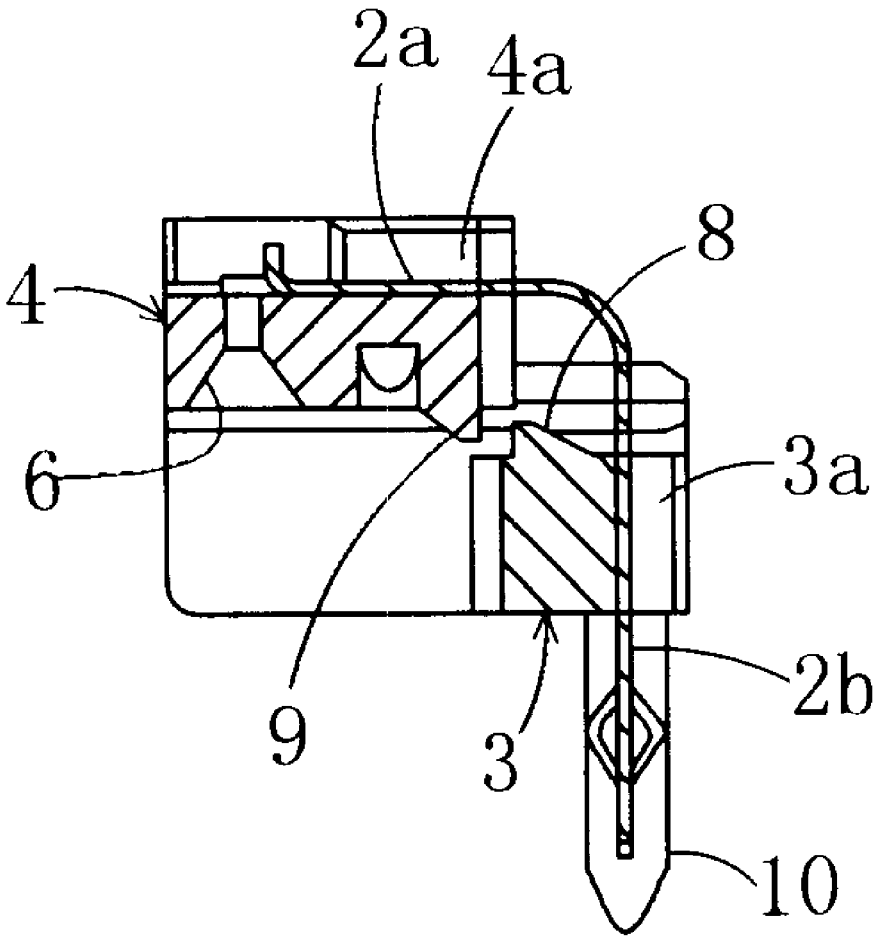
FIG. 5 is a sectional view along the line V—V of FIG. 4B.

At least a part of each contact 2 spans the base housing 3 and the slide housing 4 and is fixed onto both housings 3, 4. The contact 2 comprises a connecting part 2*a* and a mounting part 2*b* and is substantially formed into an inverted-L shape. The connecting part 2*a* is fixed on the top of the slide housing 4. The mounting part 2*b* spans both the housings 3, 4, and is fixed on the front of the slide housing 4 and the front of the base housing 3 to connect both the housings 3, 4 to each other. The contact 2 is fitted into grooves 3*a*, 4*a* concavely formed on the faces of the base housing 3 and the slide housing 4, respectively. As shown in FIG. 1, a bend 2*c* is formed on some or all of the mounting parts 2*b* of the contacts 2 by bending the mounting part 2*b* near its top end in the longitudinal direction. When these bends 3*c* are fitted in through holes made in the printed circuit board P, the bends 3*c* will undergo an elastic deformation and resulting restoring forces will tack the connector that absorbs alignment error on the printed circuit board P. Furthermore, as shown in FIG. 4A, a hole for image recognition 2*d* is formed in the connecting part 2*a* of each contact 2, and when the connecting part 2*a* is automatically soldered to a conducting member B of the counterpart, the position of the part to be soldered will be recognized to make positional error correction of the automatic soldering machine.

The slide housing 4 is provided with inlet holes 6 of which one end opens to and faces to the contact 2 and of which the other end widens toward the end, opens to and faces to the conducting member B of the counterpart. The upper end of the inlet hole 6 directly leads to the top of the contact's connecting part 2*a* on the slide housing 4, and the lower end of the inlet hole 6 opens in the bottom of the slide housing 4.

The slide housing 4 to be held between the clamping parts 5, 5 of the above-mentioned base housing 3 is provided with lateral stoppers 7, 7 that will touch and rest on the clamping parts 5, 5, when the slide housing 4 shifts sidewise. A longitudinal stopper 8 is protrusively provided on the top of the base housing 3, and a longitudinal stopper 9 is protrusively provided on the bottom of the slide housing 4, respectively, and they will touch and rest on each other when the slide housing 4 shifts forward. When the slide housing 4 is fitted on the base housing 3, one of the longitudinal stoppers 8, 9 will allow the other stopper to go over it; thus the housings can be assembled together. 10 denotes a reinforcing tab that protrudes downward from the bottom of the base housing 3. Such reinforcing tabs 10 are provided when necessary. This reinforcing tab 10 is inserted into a through hole in the printed circuit board P and soldered therein to increase the mounting strength of the connector that absorbs alignment error on the printed circuit board P.

Figure 7A:
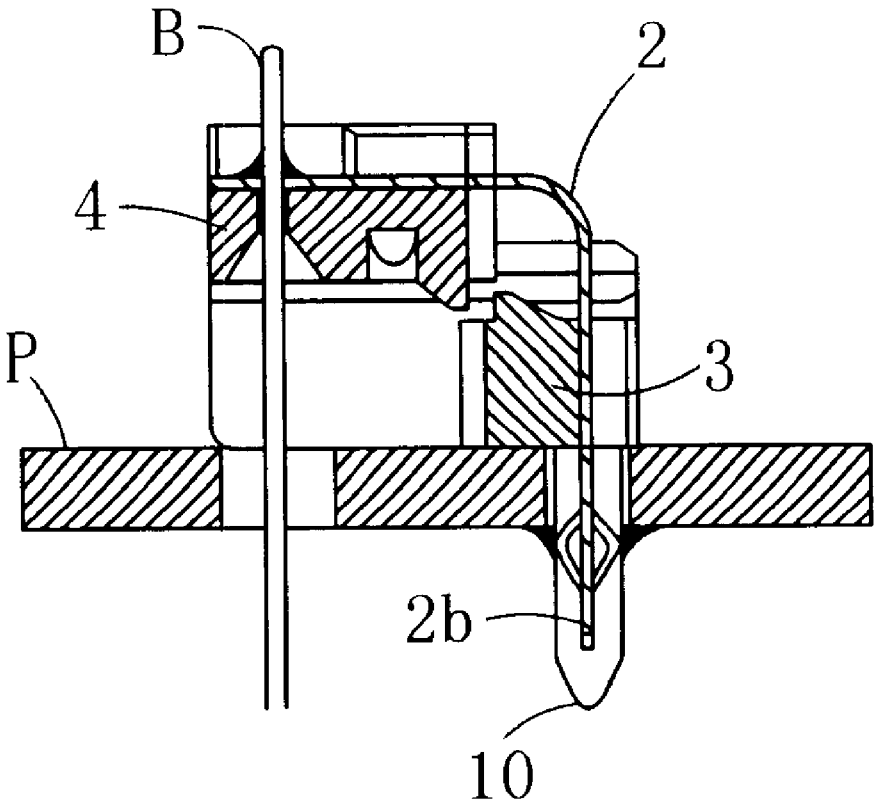
FIG. 7A and FIG. 7B are sectional views showing states of connection between a contact and a conducting member of the counterpart.

The above-mentioned first embodiment of the connector that absorbs alignment error is mounted by, as shown in FIG. 7A, soldering the top end of the mounting part 2*b* of each contact 2 onto the printed circuit board P. When a conducting member B of the counterpart is inserted into an inlet hole 6, the conducting member B of the counterpart will penetrate through the connecting part 2*a* of the contact 2. Connection is completed when both the conducting member B and the connecting part 2*a* are soldered or crimped together. In the process, even if the center of the conducting member B of the counterpart and the center of the inlet hole 6 are not aligned with each other due to alignment error, the conducting member B of the counterpart will be caught by the wide opening of the inlet hole 6, and when the conducting member B of the counterpart advances in the inlet hole 6, the slide housing 4 will slide in relation to the base housing 3 in a plane crossing the longitudinal direction of the conducting member B of the counterpart due to elastic deformation of the contact 2. Hence the conducting member B of the counterpart will be guided to the contact 2 and can be connected to it. Because alignment error can be absorbed as described above, connection failure of the connector and the conducting member B of the counterpart can be prevented effectively and the reliability of the connector is improved. Furthermore, as the stress on a soldered part, etc. is lessened in proportion to the flection of the contact 2, troubles such as cracking in the soldered part can be avoided and defective connection can be prevented from occurring. Thus the reliability of the connector is enhanced. Moreover, as the conducting member B of the counterpart is caught by the inlet hole 6 and smoothly guided deep into the inlet hole 6, the workability of assembly of the printed circuit board 6 is improved. The above-mentioned effects are particularly conspicuous when a large number of connectors and conducting members B of counterpart are mounted and they are connected collectively in a board-to-board connection.

The present invention includes embodiments wherein the connecting part 2*a* of the contact 2 is fixed on a side, the bottom or another part of the slide housing 4. However, as is the case in the above-mentioned first embodiment, when the connecting part 2*a* is fixed on the top of the slide housing 4 and the top end of the inlet hole 6 directly leads to the top of the connecting part 2*a* of the contact 2 on the slide housing 4, the conducting member B of the counterpart that penetrates the contact 2 can be soldered onto the top of the contact 2 and no drip of solder will be generated. The good effect of this arrangement is obvious when it is compared with a case wherein, as shown in FIG. 7B, a contact 2' is fitted on a single housing 1' and the top end of the contact 2' is put against the conducting member B of the counterpart and soldered.

Further, the present invention includes embodiments wherein the lateral stoppers 7, 7 and the longitudinal stoppers 8, 9 are not provided. However, as is the case in the above-mentioned first embodiment, when stoppers 7, 8, 9 are provided, lateral shift of the slide housing 4 is restrained by the lateral stoppers 7,7, forward shift of the slide housing 4 is restrained by the longitudinal stoppers 8, 9, and the ends 4*b*, 4*b* of the slide housing 4 are held by the clamping parts 5, 5 of the base housing and backward shift of the slide housing 4 is restrained by them. As these restraints set the limits of its movable range, excessive deformation of the contact 2 is prevented and troubles such as damages are prevented to improve the reliability of the connector.

Figure 7B:
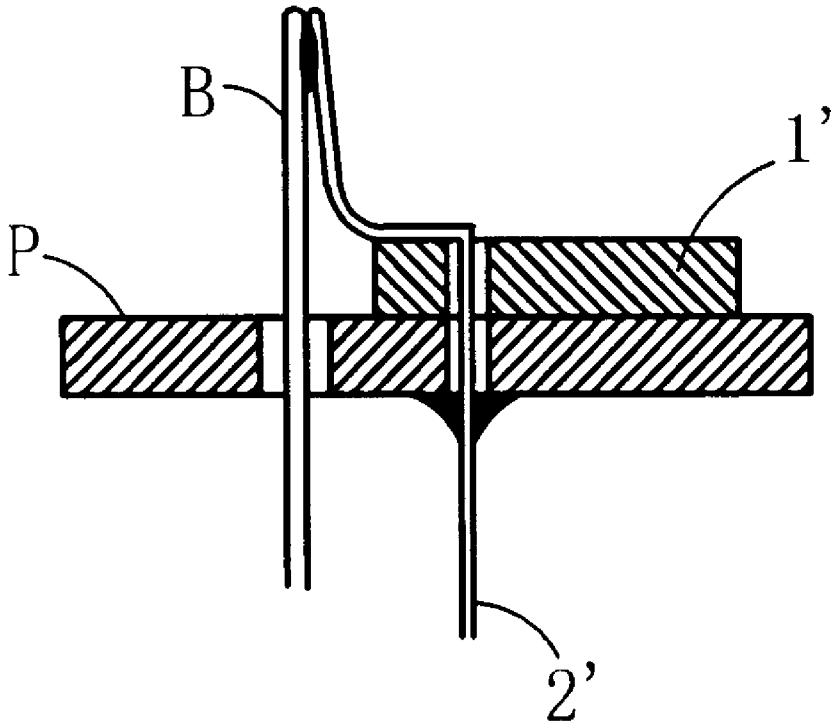

In the above-mentioned case for comparison shown in FIG. 7B, as the contact 2' protrudes bare, when the connector is mounted on a printed circuit board P and when the contact 2' is connected to a conducting member B of the counterpart, the contact 2' may hit on another member, etc. to cause a trouble, such as bending or breakage of the contact 2'. In contrast to this, in the above-mentioned first embodiment, as the connecting part 2*a* of the contact 2 is fixed to the slide housing 4 and the mounting part 2*b* is fixed to the slide housing 4 and the base housing 3, such a trouble does not occur; failure in connection between the connector and the conducting member B of the counterpart can be effectively prevented from occurring. Moreover, the present invention includes embodiments wherein contacts are directly fixed on the surface of the housing. However, as is the case in the above-mentioned first embodiment, when grooves 3*a*, 4*a* are concavely formed on the surfaces of the housings 3, 4 and the contact 2 is fitted in these grooves 3*a*, 4*a*, the contact 2 will be protected by the grooves 3*a*, 4*a*. Thus occurrence of the above-mentioned trouble is prevented, and connection failure between the contact 2 and the conducting member B of the counterpart is more effectively prevented and the reliability of the connector is improved.

The present invention includes embodiments wherein a mounting part 2*b* of a contact 2 is formed straight without any bend. However, as is the case in the above-mentioned first embodiment, when the mounting part 2*b* of the contact 2 is provided with a bend 2*c*, the connector that absorbs alignment error can be tacked to the printed circuit board P and the assembly can be brought to the next step by just inserting contacts 2 in the printed circuit board P. This eliminates a conventional step of bending the top ends of contacts that are inserted in the printed circuit board P to prevent the connector from coming off from the printed circuit board P. As a result, the efficiency of mass production is improved.

The present invention includes embodiments wherein the connecting part 2*a* of the contact 2 is not provided with a hole for image recognition 2*d*. However, as is the case in the above-mentioned first embodiment, when the hole for image recognition 2*d* is formed, positional error correction can be made by an automatic soldering machine. This improves the accuracy of soldering and improves the yield of the products.

Figure 8:
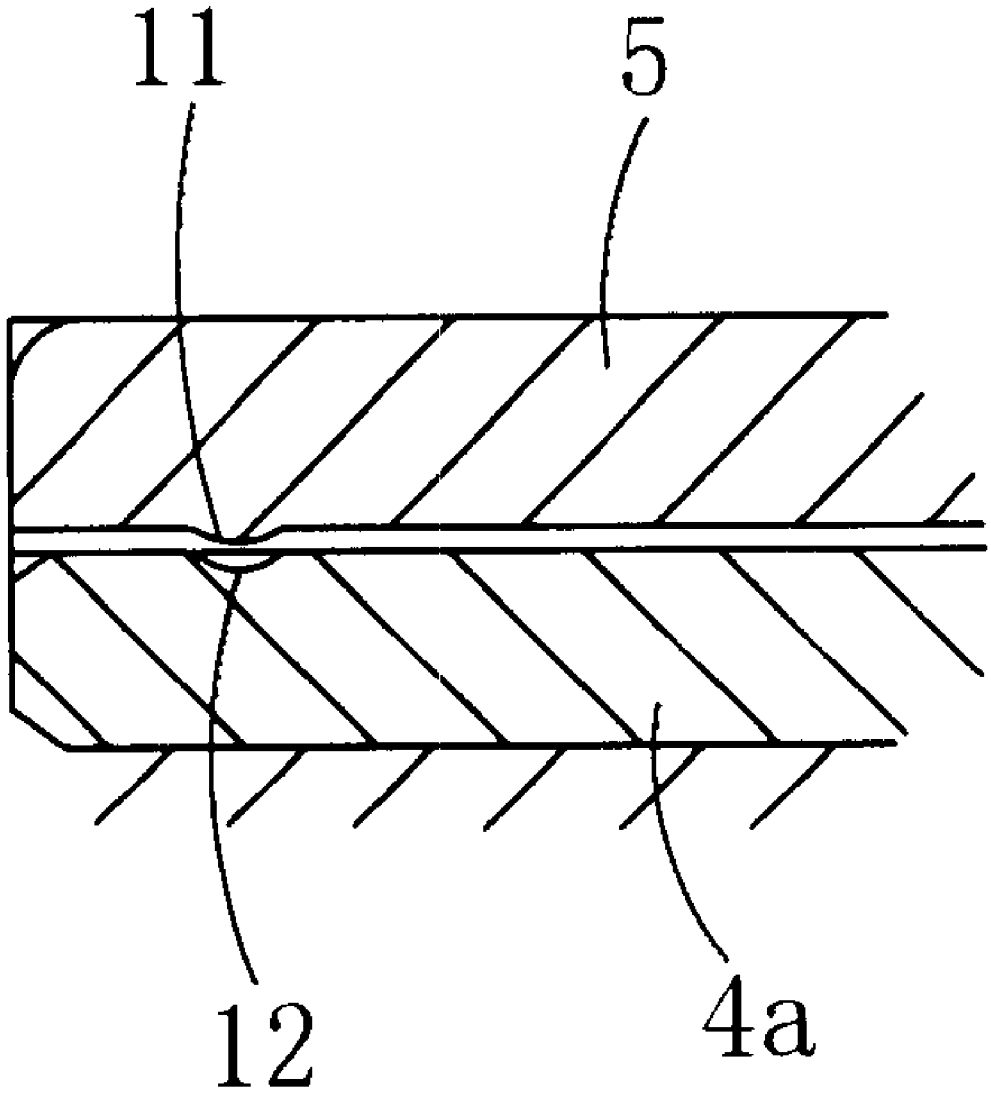
FIG. 8 is an enlarged sectional view showing a relevant part of the second embodiment of the connector that absorbs alignment error.

FIG. 8 shows the second embodiment. Only differences in structure of this second embodiment from the above-mentioned first embodiment will be described. A small protrusion 11 is formed on the bottom of the clamping part 5 of the base housing 3, and a dent 12 into which the protrusion 11 fits is concavely formed on the top of the slide housing 4, and during assembly the slide housing 4 can be tacked to the base housing 3. With this arrangement, when, for example, the slide housing 4 is tentatively fixed in the regular position in relation to the base housing 3 and the base housing 3 is mounted on the printed circuit board P, the probability of each inlet hole 6 catching the conducting member B of the counterpart will increase and, in turn, the function of absorbing alignment error will be enhanced.

Figure 9:
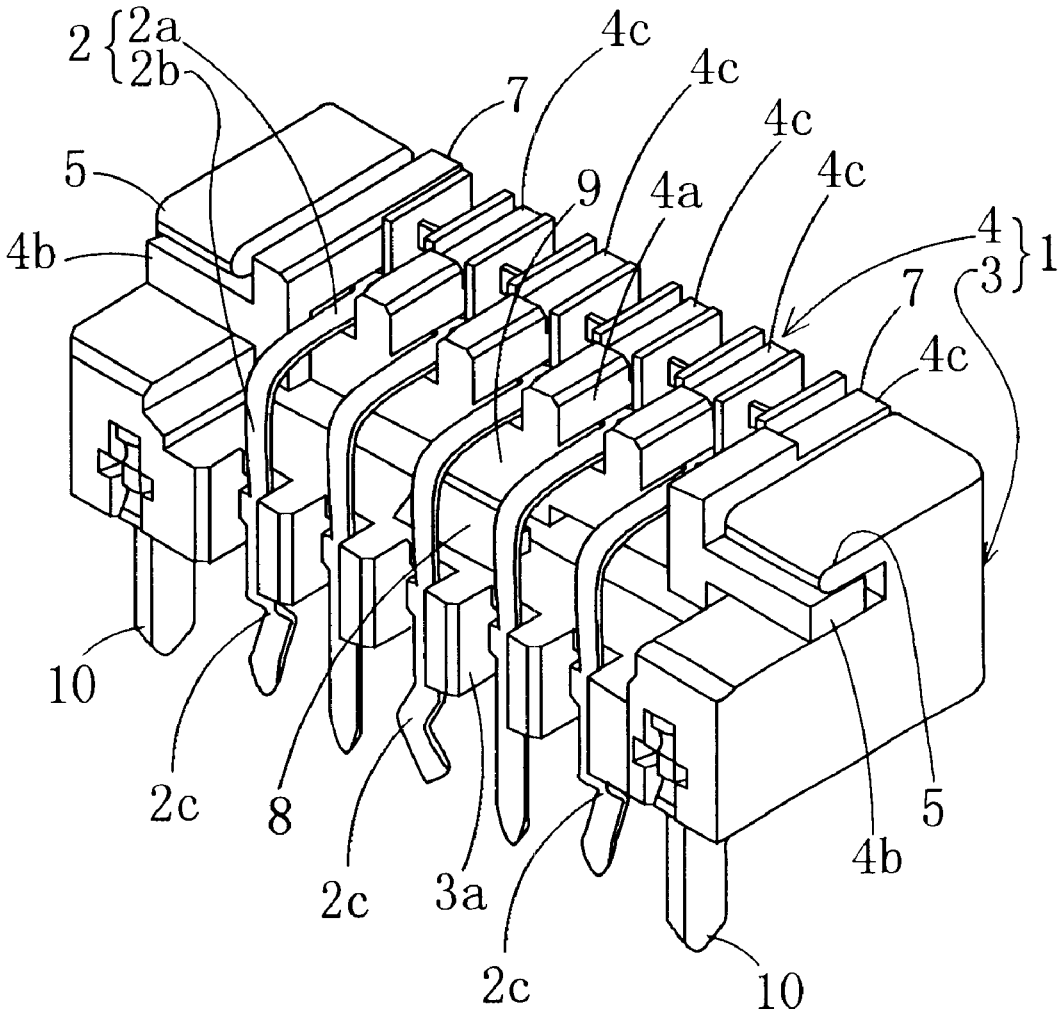
FIG. 9 is a perspective view of the third embodiment of the connector that absorbs alignment error.

FIG. 9 shows the third embodiment. Only differences in structure of this third embodiment from the above-mentioned first embodiment will be described. The top end of the connecting part 2*a* of the contact 2 is raised at both ends in the width direction to have a substantially-U-shaped section. A portion of the slide housing 4 between the above-mentioned U-shaped parts of two adjacent contacts 2, which is exposed to the effects of soldering, is partly cut away at the top to form a reduced part 4*c* which is lower in height than other portions. This eliminates portions of the slide housing 4 that might be scorched when soldering is made automatically by laser beam or the like, and in turn improves the reliability of the product and improves the yield.

The above-mentioned embodiments are just examples and the present invention is not limited by them. The connector that absorbs alignment error according to the present invention can be used extensively as a connector to be mounted on a printed circuit board, case, etc.

In the present invention, the number of the clamping parts is not limited to two, and clamping parts may be provided at three points or more. The clamping parts may be arranged to open at sides or at the rear. In such a case, when a stopper or stoppers is provided in response to this arrangement, the stopper or stoppers is provided in such a way that the slide housing does not shift towards the opening of the clamping parts.

The present invention includes other embodiments wherein the slide housing is supported in such a way that it can slide in relation to the base housing in a plane crossing the longitudinal direction of conducting member of the counterpart. For example, in one of such embodiments, a pillar is erected on the top of the base housing, this pillar is made to penetrate through the slide housing, and the gap between the pillar and the slide housing is set large.

In the above-mentioned embodiments, the contact is divided into the connecting part and the mounting part, and the mounting part spans both the housings and fixed on the front of the slide housing and the front of the base housing. The present invention, however, includes embodiments wherein another part of the contact spans both the housings and fixed to both the housings.

One end of the inlet hole faces to and opens to the above-mentioned contact. This means that the one end of the inlet hole opens near the contact. Accordingly, the present invention includes embodiments wherein one end of the inlet hole opens near an edge of the contact. The present invention includes embodiments wherein the inlet hole ends at the top of the slide housing and does not penetrate through and reach the top of the contact.

The configuration of the contact is not limited to the L-shape and includes various forms including I-shape. Also the present invention includes the embodiment wherein the number of the contact is one, the embodiments wherein the number of the contacts is two or more.

The present invention includes embodiments that are made by combining the above-mentioned embodiments in an appropriate manner.

What is claimed is:

1. A connector that absorbs alignment error for connection to a pin-shaped conducting member of a counterpart connector, said connector comprising:

a base housing for connection to a printed circuit board, said pin-shaped conducting member extending through said printed circuit board in a longitudinal direction;

a slide housing slidably supported so as to slide in relation to said base housing in a plane that crosses the longitudinal direction of said pin-shaped conducting member when said base housing is positioned on the printed circuit board; and at least one contact spanning said base housing and said slide housing, said at least one contact being fixedly attached to said base housing and said slide housing and soldered on said printed circuit board, wherein said slide housing includes at least one inlet hole having a top end which faces and opens towards said at least one contact and a bottom end which widens toward the end of said inlet hole and open to said pin-shaped conducting member.

2. A connector that absorbs alignment error of claim 1, wherein said base housing includes first and second clamping parts formed into a fallen-U-shape and opening forward, said first and second clamping parts laterally spaced away from each other with respect to the top of said base housing to slidably hold said slide housing, wherein said at least one contact is formed into a substantially inverted L-shape and includes a connecting part and a mounting part, said connecting part fixedly attached to said slide housing, and said mounting part fixedly attached to the top of said slide housing and the front of said base housing so as to span said slide housing and said base housing, and wherein said top end of said inlet hole penetrates through to the top of a connecting part of said at least one contact and said bottom end of said inlet hole opens at the bottom of said slide housing.

3. A connector that absorbs alignment error of claim 2, wherein said slide housing includes lateral stoppers which abut said first and second clamping parts when said slide housing shifts laterally with respect to the top of said base housing, and wherein said base housing includes a longitudinal stopper on the top thereof and said slide housing includes a longitudinal stopper on the bottom thereof, said longitudinal stoppers abutting each other when said slide housing shifts longitudinally with respect to the top of said base housing.

* * * * *